United States Patent [19]

Ogawa

[11] Patent Number: 4,580,121

[45] Date of Patent: Apr. 1, 1986

[54] MAGNET ROLL AND METHOD FOR MANUFACTURING THE SAME

[75] Inventor: Toshiyuki Ogawa, Kawasaki, Japan

[73] Assignee: Ricoh Company, Ltd., Japan

[21] Appl. No.: 574,910

[22] Filed: Jan. 30, 1984

[30] Foreign Application Priority Data

Jan. 29, 1983 [JP] Japan ..... 58-12105

[51] Int. Cl.[4] ..... H01F 7/02

[52] U.S. Cl. ..... 335/303; 335/306; 118/657; 355/3 DD

[58] Field of Search ..... 335/303, 306; 118/657, 118/658; 355/3 DD

[56] References Cited

U.S. PATENT DOCUMENTS

| | | | |
|---|---|---|---|
| 3,208,296 | 9/1965 | Baermann | 118/657 X |
| 3,643,629 | 2/1972 | Kangas et al. | 335/303 X |
| 3,742,852 | 7/1973 | Leffler et al. | 335/306 |

OTHER PUBLICATIONS

IBM Technical Disclosure Bulletin, vol. 17, No. 9, Feb. 1975, p. 2693, Magnetic Field Control for Magnetic Brush Developer, R. E. Ellis.

*Primary Examiner*—George Harris
*Attorney, Agent, or Firm*—Guy W. Shoup

[57] ABSTRACT

A magnet roll for use in a developing device for developing an electrostatic latent image in an electrophotographic copier is provided. The magnet roll may be rotatably disposed inside of a developing sleeve so that magnetic toner may be transported along the circumference of the sleeve as magnetically attracted to the peripheral surface of the sleeve. The present magnet roll includes an impeller-shaped support and a plurality of magnet members provided as mounted on the support only at desired locations. The magnet member contains a matrix component, such as nitrile-butadiene rubber, and a magnetic component, such as ferrite powder. Therefore, the present magnet roll is light in weight and sturdy in structure.

18 Claims, 7 Drawing Figures

MAGNET ROLL AND METHOD FOR MANUFACTURING THE SAME

BACKGROUND OF THE INVENTION

1. Field of the Invention

This invention relates to a magnet roll and method for manufacturing the same, and particularly to a magnet roll suitable for use in a developing device of electrophotographic copier as disposed inside of a developing sleeve along the circumference of which is transported toner.

2. Description of the Prior Art

In a developing device for developing an electrostatic latent image formed on an imaging surface, such as the surface of an electrophotographic member, by application of toner to the latent image, a developing sleeve is rotatably provided as a toner carrier and a magnet roll is disposed inside of the sleeve thereby producing a magnetic field at the surface of the sleeve to have the toner magnetically attracted to the peripheral surface of the sleeve. Such a magnet roll typically includes a magnet formed by sintering a magnetic material such as ferrite. In this case, however, since ferrite is brittle, there is difficulty in forming various shapes using ferrite and ferrite must be provided at those locations where unnecessary so as to maintain its integrity when manufactured. For this reason, the prior art magnet roll tended to be heavier in weight and higher in manufacturing cost thereby requiring the provision of costly associated parts for supporting and driving to rotate the magnet roll. Moreover, since the prior art magnet roll was manufactured by sintering, there was a difficulty in dimensional control due to distortions caused by sintering, which could also hinder to attain an intended performance. It is true that a secondary processing may be carried out to the magnet roll after sintering to attain a desired dimensional accuracy, but such a secondary processing will push up the manufacturing cost.

FIG. 1 shows a prior art doughnut-shaped magnet roll 1. In this case, the doughnut-shaped magnet 1*a* was first formed by sintering and then fitted onto and fixed to a shaft 1*b*, for example, by an appropriate adhesive. In this example, the outer peripheral surface of the magnet 1*a* required to be abraded as a secondary step so that there was a difficulty in manufacture. Besides, the overall structure was quite heavy and thus it required a large amount of driving power for rotation.

FIG. 2 shows another prior art magnet roll 2 which is suited for providing a plurality of magnetic poles at unequal spacing as different from the structure of FIG. 1. In this case also, the overall structure is doughnut-shaped with intermediate portions A interposed between adjacent magnetic portions 2*a* in order to increase integrity of the structure. This magnet roll is also disadvantageous because the portions A must be provided to compensate the physical weakness of ferrite magnets 2*a* thereby increasing not only weight but also cost.

FIG. 3 shows a further prior art magnet roll 3 which was proposed to overcome the shortcomings of the previous two prior art magnet rolls shown in FIGS. 1 and 2. That is, in this case, in order to make the overall structure light in weight by removing unnecessary portions, a plurality of elongated, rectangularly shaped magnets 3*a* were first manufactured and fixedly attached to a cylindrical support 4 at those locations where required. In this case, it is true that the overall weight may be minimized, but the manufacturing steps are increased because a plurality of magnets 3*a* must be fixedly attached to the support 4 one after another. Moreover, the shape of support 4 is rather complicated because of required positioning and secure holding of the individual magnets 3*a*, so that there is produced another difficulty in forming the support 4. On the other hand, since the magnet 3*a* is rectangular in cross section, the largest gap G is formed between the magnet 3*a* and the inner peripheral surface of a developing sleeve 5 at the midpoint G1 of the magnet 3*a* where the largest magnetic force is normally required when assembled, as shown in FIG. 4. Thus, the structure of FIG. 3 is disadvantageous also from the viewpoint of performance. It is true that one side of the magnet 3*a* may be formed into a shape to be in compliance with the inner peripheral surface of the sleeve 5; however, such a secondary processing can be a cause of pushing up the manufacturing cost.

SUMMARY OF THE INVENTION

It is therefore a primary object of the present invention to provide an improved magnet roll and method for manufacturing the same.

Another object of the present invention is to provide a magnet roll which is light in weight and sturdy in structure.

A further object of the present invention is to provide a magnet roll which is suitable for use in a developing device for developing an electrostatic latent image with the application of toner to the latent image.

A still further object of the present invention is to provide a method for manufacturing a magnet roll with ease and at low cost.

A still further object of the present invention is to provide a method for manufacturing a magnet roll with high dimensional accuracy without increasing cost.

Other objects, advantages and novel features of the present invention will become apparent from the following detailed description of the invention when considered in conjunction with the accompanying drawings.

DESCRIPTION OF THE PREFERRED EMBODIMENTS

Figure 5:
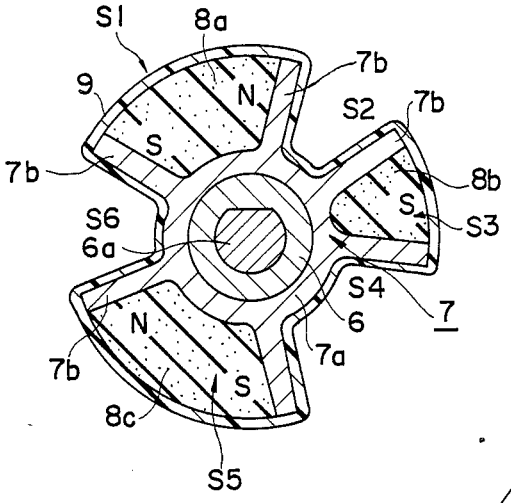
FIGS. 5 and 6 are schematic illustrations showing two magnet rolls embodying the present invention.

Referring now to FIG. 5, there is shown in cross section a magnet roll constructed in accordance with one embodiment of the present invention when applied to a developing device for developing an electrostatic latent image in an electrophotographic copier. As shown, the structure of FIG. 5 includes a rotary shaft 6 onto which is tightly fitted a support 7. A driving shaft 6*a* of a motor ( not shown ) is integrally fitted into the hollow portion of support 7 so that the support 7 may be set in rotation around the central axis of the rotary shaft 6 as driven by the motor. As shown, the support 7 for securely supporting magnets 8 thereon includes a cylindrical portion 7*a* and a plurality of fins 7*b* extending generally radially from the outer peripheral surface of the cylindrical portion 7*a* at predetermined positions. In the embodiment illustrated in FIG. 5, six fins 7*b* are provided as extending radially outwardly from the outer peripheral surface of the cylindrical portion 7*a* and three magnet members 8*a*, 8*b* and 8*c* are provided in spaces S1, S3 and S5, respectively, with five magnetic poles arranged at the outer periphery of magnet roll at unequal spacing.

The support 7 is thus generally in the shape of an impeller, and, thus, it may be manufactured easily by extrusion. Accordingly, the impeller-shaped support 7 may preferably be manufactured by extrusion from a light weight material such as aluminum. In this manner, in the present invention, the support 7 may be fabricated quite easily from an inexpensive and light weight material, thereby contributing to keep the manufacturing cost low and the overall structure light in weight. The support 7 thus fabricated is then tightly fitted onto the rotary shaft 6 thereby forming an integrated structure.

As described before, the impeller-shaped support 7 includes six fins 7*b* extending radially outwardly from the cylindrical portion 7*a* so that there are defined six regions S1 through S6 between any two adjacent fins. In the present embodiment, magnet members 8*a*, 8*b* and 8*c* are only provided in the regions S1, S3 and S5, respectively, with the other regions S2, S4 and S6 left unused. These magnet members 8*a*, 8*b* and 8*c* are comprised of a composite material containing a matrix component, such as nitrile-butadiene rubber, and a magnetic component, such as ferrite. The magnet member 8 thus formed has a specific weight of approximately 3.5 which is significantly smaller as compared with the specific weight of 6 or more possessed by the prior art sintered-ferrite magnet; moreover, the present magnet member 8 is far less brittle. In addition, the present magnet member 8 is easily formable to any desired shape and it deforms very little once formed into a desired shape, thereby allowing to secure accurate dimensional control and performance. As the matrix component, instead of a nitrile-butadiene rubber family material, use may also be made of various resin materials, such as chlorinated polyethylene, which may be uniformly mixed with ferrite particles.

Figure 1:
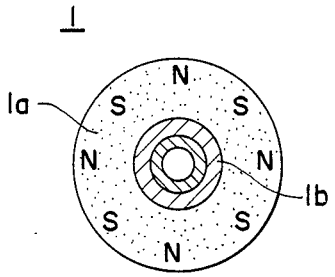
Fig. 1 Prior Art
FIGS. 1 through 3 are schematic illustrations showing several typical prior art magnet rolls using ferrite as a magnetic material.
Figure 2:
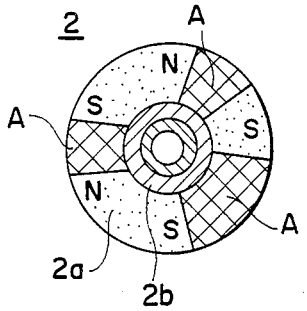
Fig. 2 Prior Art
Figure 3:
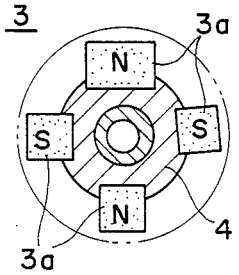
Fig. 3 Prior Art
Figure 4:
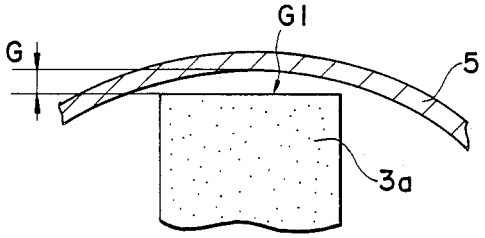
Fig. 4 Prior Art
FIG. 4 is a fragmentary, enlarged view showing in detail part of the structure of FIG. 3.

As described above, in accordance with the present invention, the impeller-shaped support 7 is comprised of aluminum, which is a light weight material, and the magnet 8 is comprised of a composite material including an appropriate matrix component and a magnetic component and provided only where required, and, thus, the magnet roll of the present invention may be made far lighter in weight than the prior art magnet rolls. For example, the overall weight of the present magnet roll may be reduced to half of that of the magnet roll shown in FIG. 2. When compared with the magnet roll shown in FIG. 3, the overall weight may be reduced approximately by 30%. These comparisons were made with the magnet rolls of 40 mm in outer diameter; however, the larger the diameter, the more the differences in weight.

As shown, in the embodiment of FIG. 5, there is also provided a heat-shrinkable tubing 9 which encloses the magnet roll structure including the impeller-shaped support 7 and the magnet members 8*a* through 8*c* as a unit thereby allowing to increase the integrity between the support 7 and the magnets 8.

Figure 6:
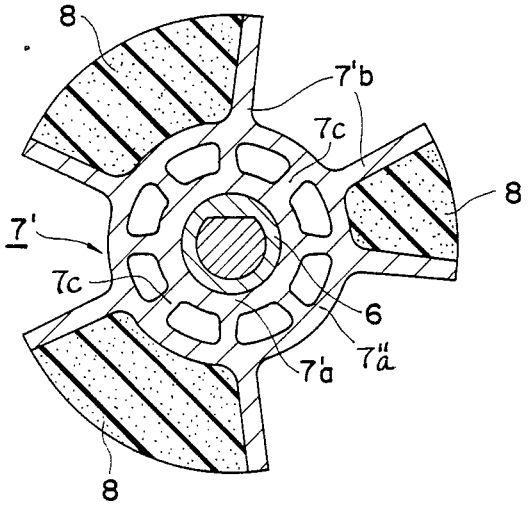

FIG. 6 shows another embodiment of the present invention, which is directed to provide a magnet roll which is, in principle, structurally the same as the previous embodiment shown in FIG. 5 but larger in diameter. As shown, in this embodiment, the magnet members 8 are made as small as practicably possible and the impeller-shaped support 7′ includes a pair of cylindrical portions 7′*a* and 7″*a* which are different in diameter and arranged concentrically and are connected by a plurality of ribs 7*c* extending therebetween and a plurality of fins 7′*b*, six in the illustrated example, which extend radially outwardly from the outer periphery of the outer cylindrical portion 7″*a*. Thus, there are defined a plurality, six in the illustrated example, of regions for mounting the magnet member 8. In the present embodiment, the impeller-shaped support 7′ may also be formed from aluminum. It will be appreciated that the magnet roll of FIG. 6 may be made extremely light in weight from the viewpoint of a material to be used and from the viewpoint of physical structure it provides.

Now, a method for manufacturing the present magnet roll having the above-described structure will be described below with particular reference to FIG. 5. In the first place, the impeller-shaped support 7 is formed from aluminum by extrusion. Then, the thus formed support 7 is tightly fitted onto the rotary shaft 6 which has been prepared previously. In this instance, if the resulting magnet roll is to be used under relatively light load condition, then the rotary shaft 6 and the support 7 may be formed integrally from the same material at the same time by extrusion. After formation of the support 7, the magnet members 8 are provided only in the regions S defined between any two adjacent fins 7*b* and 7*b* as fixedly attached to the support 7. In the present embodiment, a flowable composite material which is prepared by uniformly mixing a molten matrix component of nitrile-butadiene rubber with a magnetic component of ferrite particles is directely poured into the selected regions S1, S3 and S5 with the application of a magnetic field, and, then, the thus supplied composite material is solidified, thereby providing the magnet members 8*a*, 8*b* and 8*c* as fixedly mounted in the selected regions S1, S3 and S5, respectively. In this instance, it is preferable to use an appropriate shape-forming member, such as a cylindrical cover which may be fitted onto the support 7, thereby allowing to form the magnet members 8*a*, 8*b* and 8*c* as shown in FIG. 5 when hardened. In this case, the present magnet roll may be manufactured with a minimum number of processing steps and a high dimensional accuracy. The above-described method may be equally applied to the case in which use is made of a resin as the matrix component.

Figure 7:
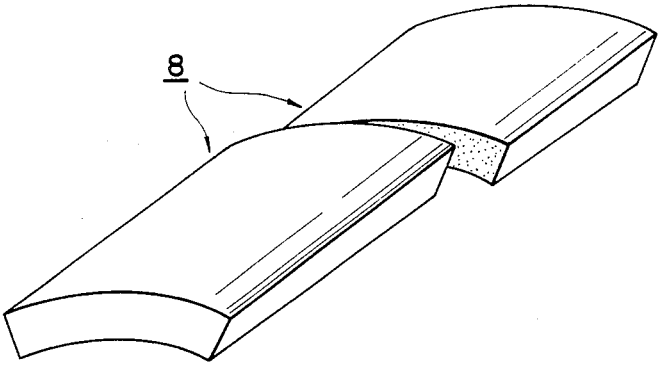
FIG. 7 is a perspective, schematic view showing a further embodiment of the present invention in which magnets 8 are first manufactured separately and then fixedly attached to its support.

An alternative method for providing the magnet members 8 to the impeller-shaped support 7 will now be described with particular reference to FIG. 7. In this case, the composite material is not directly flowed into the selected regions; instead, the individual magnet members 8*a*, 8*b* and 8*c* are separately formed by using respective molds. Then, the separately formed magnet members 8*a*, 8*b* and 8*c* are fixedly attached to the support 7 at their respectively selected regions using an adhesive or the like. In this case, since the support 7 is impeller-shaped, the positioning of each of the magnet members 8*a*, 8*b* and 8*c* is extremely easy and accurate.

In the illustrated example, after provision of the magnet members 8*a*, 8*b* and 8*c* in the respectively selected regions S1, S3 and S5, the heat-shrinkable tubing 9 is fitted onto the entire structure and heat is applied to the tubing 9 so that the tubing 9 may be brought into contact with the entire outer surface of the magnet roll. If the heat-shrinkable tubing 9 can keep the magnet members 8*a*, 8*b* and 8*c* in position during the operation of the magnet roll, then the use of adhesive may be omitted.

As described in detail above, in accordance with the present invention, a magnet roll comprises an impeller-shaped support and an appropriate number of magnet members formed from a composite material which is a mixture including a matrix component, such as rubber and resin, and a magnetic component, such as ferrite particles, and provided as mounted on the support only where necessary. Accordingly, the present invention may provide a magnet roll which is extremely light in weight and yet sturdy structurally.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A magnet roll for use in a developing device employing a magnetic developer comprising:

a support including a base portion and a plurality of fins extending generally radially outwardly from said base portion and defining a first plurality of regions therebetween; and a second plurality, which is different in number from said first plurality, of magnet members each of which is provided in the corresponding one of selected regions defined between any two adjacent ones of said plurality of fins and then each of which includes a composite material which is a mixture of a matrix component and a magnetic component.

2. A magnet roll of claim 1 wherein said matrix component is nitrile-butadiene rubber and said magnetic component is ferrite powder.

3. A magnet roll of claim 1 wherein said matrix component is a resin and said magnetic component is ferrite powder.

4. A magnet roll of claim 1 wherein said base portion is cylindrical in shape and is integrally formed with said first plurality of fins.

5. A magnet roll of claim 4 wherein said support is made of a light weight material.

6. A magnet roll of claim 5 wherein said light weight material is aluminum.

7. A magnet roll of claim 4 wherein said second plurality of magnet members are fixedly attached to said support by means of an adhesive.

8. A magnet roll of claim 4 wherein said base portion includes a first cylindrical base portion, a second cylindrical base portion disposed concentrically with and radially outside of said first cylindrical base portion and a plurality of ribs extending between said first and second cylindrical base portions.

9. A magnet roll of claim 1 further comprising a cover which encloses at least the entire outer circumference of said magnet roll.

10. A magnet roll of claim 9 wherein said cover is a heat-shrinkable tubing.

11. A method for manufacturing a magnet roll for use in a developing device employing a magnetic developer, comprising the steps of:

forming a support including a base portion and a plurality of fins extending generally radially outwardly from said base portion and defining a first plurality of regions therebetween;

pouring a molten composite material including a matrix component and a magnetic component into a second plurality, which is different in number from said first plurality, of selected regions each of which is defined between any two adjacent ones of said plurality of fins while providing application of a magnetic field; and causing said molten composite material to harden in said second plurality of selected regions.

12. A method of claim 11 wherein said support is formed by extrusion during said step of forming a support.

13. A method of claim 12 wherein said matrix component is nitrile-butadiene rubber and said magnetic component is ferrite powder.

14. A method of claim 12 wherein said matrix component is resin and said magnetic component is ferrite powder.

15. A method for manufacturing a magnet roll for use in a developing device employing a magnetic developer, comprising the steps of:

forming a support including a base portion and a plurality of fins extending generally raidally outwardly from said base portion and defining a first plurality of regions therebetween;

preparing a second plurality, which is different in number from said first plurality, of magnet members, each of which may be fitted into a selected one of said regions defined between two adjacent ones of said plurality of fins; and fitting said second plurality of magnet members into the corresponding one of said selected regions thereby causing said magnet members to be fixedly attached to said support.

16. A method of claim 15 wherein said supported is formed by extrusion during the step of forming a support.

17. A method for manufacturing a magnet roll for use in a developing device employing a magnetic developer, comprising the steps of:

forming a support including a base portion and a plurality of fins extending generally radially outwardly from said base portion and defining a first plurality of regions therebetween;

preparing a second plurality, which is different in number from said first plurality, of magnet members, each of which may be fitted into a selected one of said regions defined between two adjacent ones of said plurality of fins;

fitting said second plurality of magnet members into the corresponding ones of said selected regions; and fitting a heat-shrinkable tubing onto said support with said magnet members placed in position whereby heat is applied to cause said heat-shrinkable tubing to be shrunk appropriately thereby forming an integrated structure between said support and said magnet members.

18. A method of claim 17 wherein said support is formed by extrusion during the step of forming a support.

* * * * *